US006767258B2

(12) United States Patent
Chien

(10) Patent No.: US 6,767,258 B2
(45) Date of Patent: Jul. 27, 2004

(54) CONNECTOR SEAT OF COMPUTER BUS

(75) Inventor: Min Ju Chien, Keelung (TW)

(73) Assignee: Giga-Byte Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/278,780

(22) Filed: Oct. 24, 2002

(65) Prior Publication Data

US 2003/0199202 A1 Oct. 23, 2003

(30) Foreign Application Priority Data

Apr. 19, 2002 (TW) ..... 91205483 U

(51) Int. Cl.[7] ..... H01R 13/64
(52) U.S. Cl. ..... 439/680; 439/374
(58) Field of Search ..... 439/374, 680

(56) References Cited

U.S. PATENT DOCUMENTS 4,900,261 A * 2/1990 Gentry et al. ..... 439/353
5,147,225 A * 9/1992 Kile et al. ..... 439/680
6,203,380 B1 * 3/2001 Harting et al. ..... 439/680

* cited by examiner

*Primary Examiner*—Gary Paumen
*Assistant Examiner*—James R. Harvey
(74) *Attorney, Agent, or Firm*—Rosenberg, Klein & Lee

(57) ABSTRACT

A connector seat of a computer bus has four side walls. Each of the four side walls has two adjacent side walls. The connector seat is formed with at least two openings each located between one of the four side walls and each of its two adjacent side walls, so that the one side wall is capable of being oscillated outward. Thus, when the user swings or oscillate the bus connector so as to remove the bus connector from the socket of the connector seat, at least one of the side walls of the connector seat may be oscillated with the bus connector, and will not be broken due to the stress or pressure produced when the user swings or oscillates the bus connector.

5 Claims, 4 Drawing Sheets

CONNECTOR SEAT OF COMPUTER BUS

BACKGROUND OF THE INVENTION

1. Field of the Invention

The present invention relates to a connector seat of a computer bus, and more particularly to a connector seat of a computer bus, wherein the side walls of the connector seat may be oscillated with the bus connector, and will not be broken due to the stress or pressure produced when the user swings or oscillates the bus connector.

2. Description of the Related Art

A first conventional connector seat 3 of a computer bus in accordance with the prior art shown in FIG. 3 has four side walls 30 with a socket 31 formed between the four side walls 30 for insertion of a bus connector 4. Each of two opposite shorter side walls 30 is formed with an insertion recess 32 for snapping a hook (not shown) of another bus connector (not shown). The bus connector 4 is inserted into the socket 31 of the connector seat 3 in a close fit manner, thereby preventing the bus connector 4 from being detached from the socket 31 of the connector seat 3 easily. Thus, the user cannot remove the bus connector 4 from the socket 31 of the connector seat 3 easily. In such a manner, the user has to swing or oscillate the bus connector 4 so as to remove the bus connector 4 from the socket 31 of the connector seat 3. However, the socket 31 of the connector seat 3 is closed by the four side walls 30, so that the four side walls 30 are easily broken due to the stress or pressure produced when the user swings or oscillates the bus connector 4.

A second conventional connector seat 5 of a computer bus in accordance with the prior art shown in FIG. 4 has four side walls 50 with a socket 51 formed between the four side walls 50 for insertion of a bus connector 6. Each of two opposite shorter side walls 50 is formed with a notch 500 which may provide a movable space when the user swings or oscillates the bus connector 6, thereby reducing the pressure applied on the four side walls 50 of the connector seat 5, so that the four side walls 50 of the connector seat 5 are not easily broken. However, the four side walls 50 of the connector seat 5 are still connected mutually, so that the oscillation space of the bus connector 6 is limited. In addition, the close fit between the bus connector 6 and the socket 31 of the connector seat 3 is reduced by the notches 500, so that the bus connector 6 is easily detached from the socket 31 of the connector seat 3 easily. Further, each of the two opposite shorter side walls 50 of the connector seat 5 is not formed with an insertion recess for snapping a hook (not shown) of another bus connector (not shown), thereby decreased the versatility of the connector seat 5.

SUMMARY OF THE INVENTION

The present invention has arisen to mitigate and/or obviate the disadvantage of the conventional connector seat of a computer bus.

The primary objective of the present invention is to provide a connector seat of a computer bus, wherein when the user swings or oscillate the bus connector so as to remove the bus connector from the socket of the connector seat, at least one of the side walls of the connector seat may be oscillated with the bus connector, and will not be broken due to the stress or pressure produced when the user swings or oscillates the bus connector.

Another objective of the present invention is to provide a connector seat of a computer bus, wherein the connector seat is both available for a bus connector with a side hook and a bus connector without a side hook.

A further objective of the present invention is to provide a connector seat of a computer bus, wherein the bus connector is inserted into the socket of the connector seat in a close fit manner, so that the bus connector cannot be detached from the socket of the connector seat 2 easily.

In accordance with the present invention, there is provided a connector seat of a computer bus, having four side walls, wherein:

each of the four side walls has two adjacent side walls; and the connector seat is formed with at least two openings each located between one of the four side walls and each of its two adjacent side walls, so that the one side wall is capable of being oscillated outward.

Further benefits and advantages of the present invention will become apparent after a careful reading of the detailed description with appropriate reference to the accompanying drawings.

DETAILED DESCRIPTION OF THE INVENTION

Figure 1:
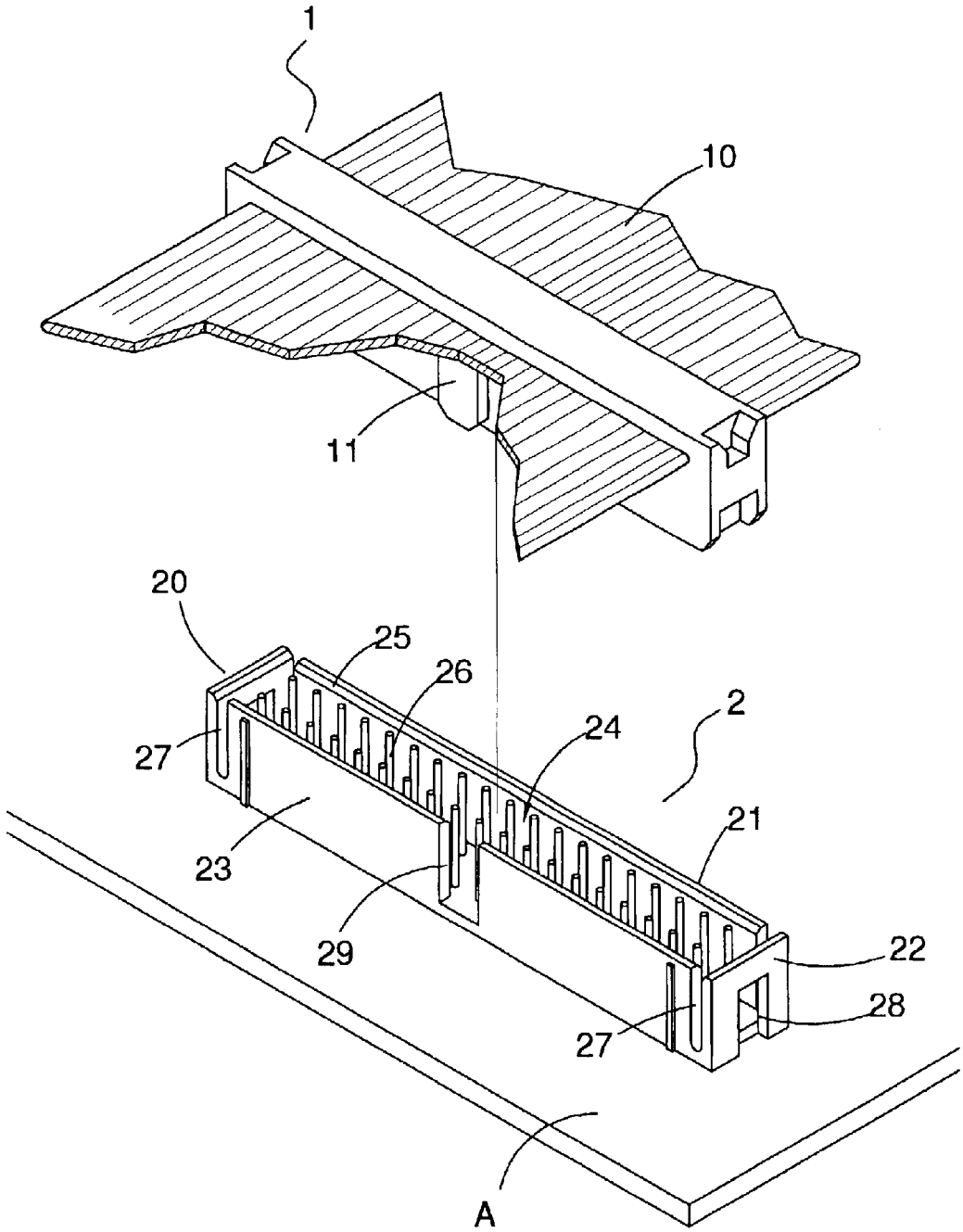
FIG. 1 is a perspective view of a connector seat of a computer bus in accordance with a preferred embodiment of the present invention.

Referring to the drawings and initially to FIG. 1, a connector seat 2 of a computer bus in accordance with a preferred embodiment of the present invention is mounted on a circuit board "A" for insertion of a bus connector 1.

The bus connector 1 is provided with a computer bus 10, and has one side provided with a positioning plug 11.

The connector seat 2 has a first side wall 20, a second side wall 21, a third side wall 22 located opposite to the first side wall 20, and a fourth side wall 23 located opposite to the second side wall 21. The connector seat 2 is formed with a socket 24 located between the four side walls 20, 21, 22 and 23 for insertion of the bus connector 1. Each of the first side wall 20, the second side wall 21, the third side wall 22 and the fourth side wall 23 of the connector seat 2 has a top having an inner side provided with a chamfered guide face 25, thereby facilitating insertion of the bus connector 1 into the socket 24 of the connector seat 2. The connector seat 2 is provided with a plurality of conductive legs 26 located in the socket 24.

The connector seat 2 is formed with four openings 27 each located between the first side wall 20 and the second side wall 21, between the second side wall 21 and the third side wall 22, between the third side wall 22 and the fourth side wall 23, and between the fourth side wall 23 and the first side wall 20. Each of the openings 27 of the connector seat 2 has an arc-shaped bottom. Each of the first side wall 20 and the third side wall 22 of the connector seat 2 is formed with an insertion recess 28 for snapping a side hook (not shown) of another bus connector (not shown), thereby enhancing the stability and rigidity of the connector seat 2. The fourth side wall 23 is formed with a positioning recess 29 for insertion of the positioning plug 11 of the bus connector 1.

Figure 2:
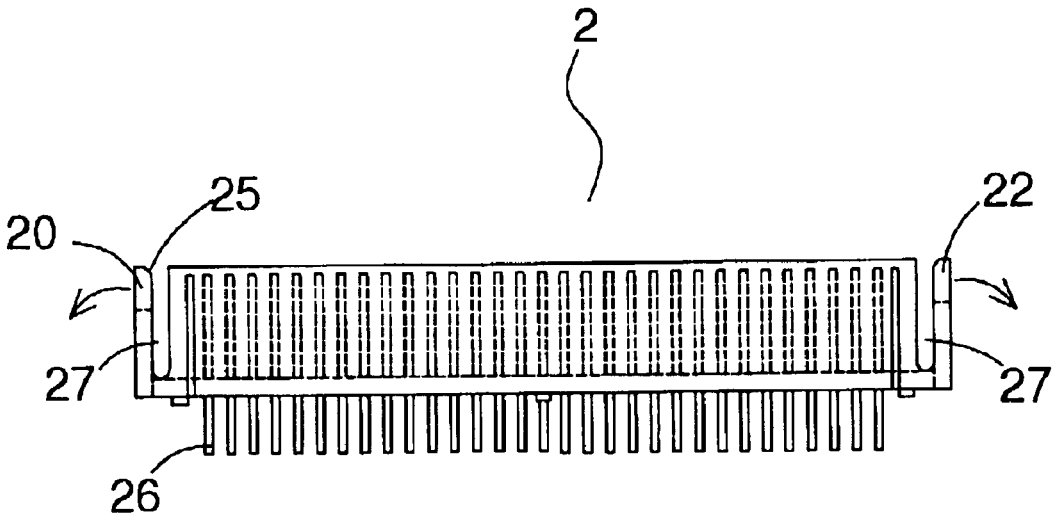
FIG. 2 is a side plan view of the connector seat of a computer bus as shown in FIG. 1.
Figure 3:
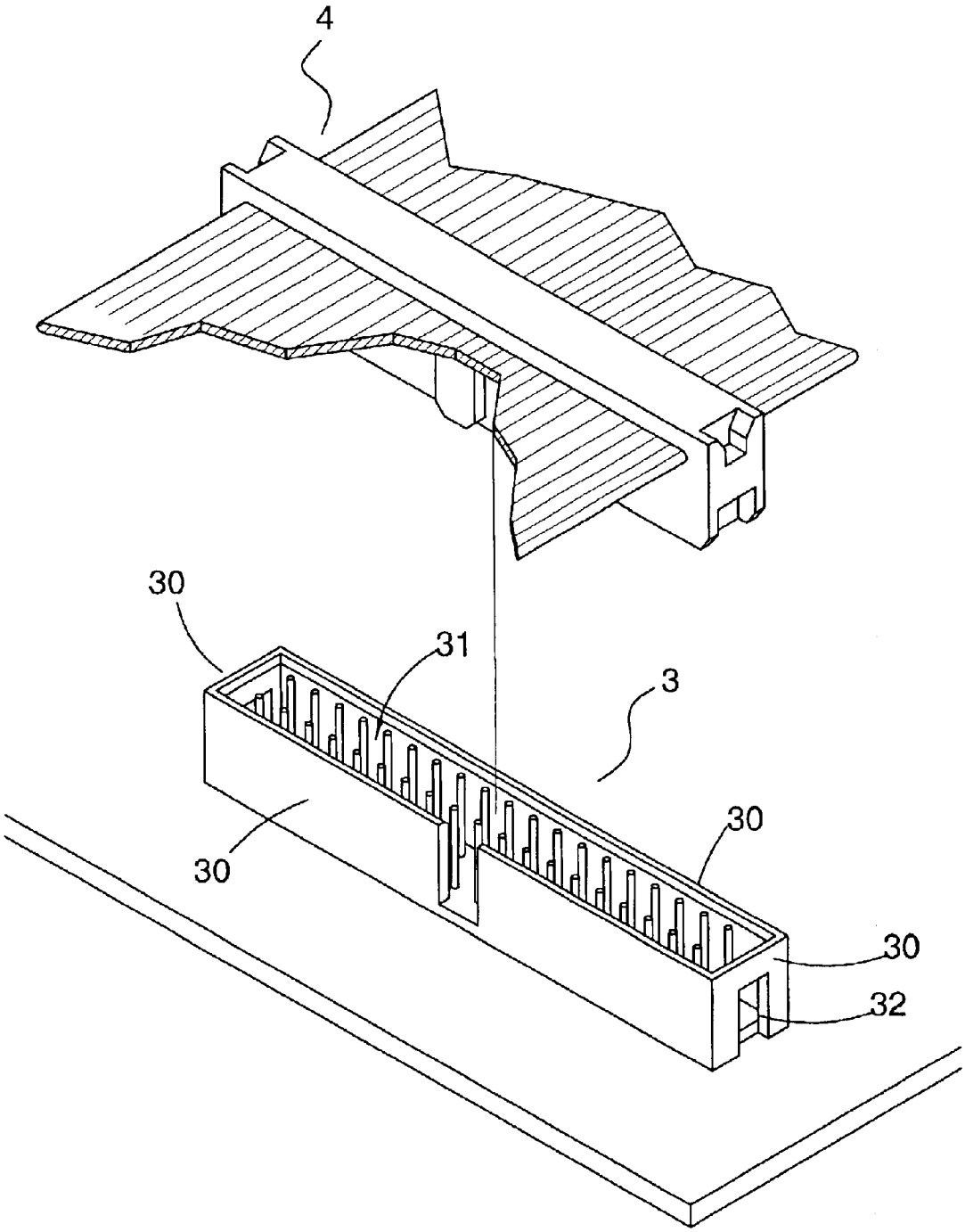
FIG. 3 (PRIOR ART)
FIG. 3 is a perspective view of a first conventional connector seat of a computer bus in accordance with the prior art.
Figure 4:
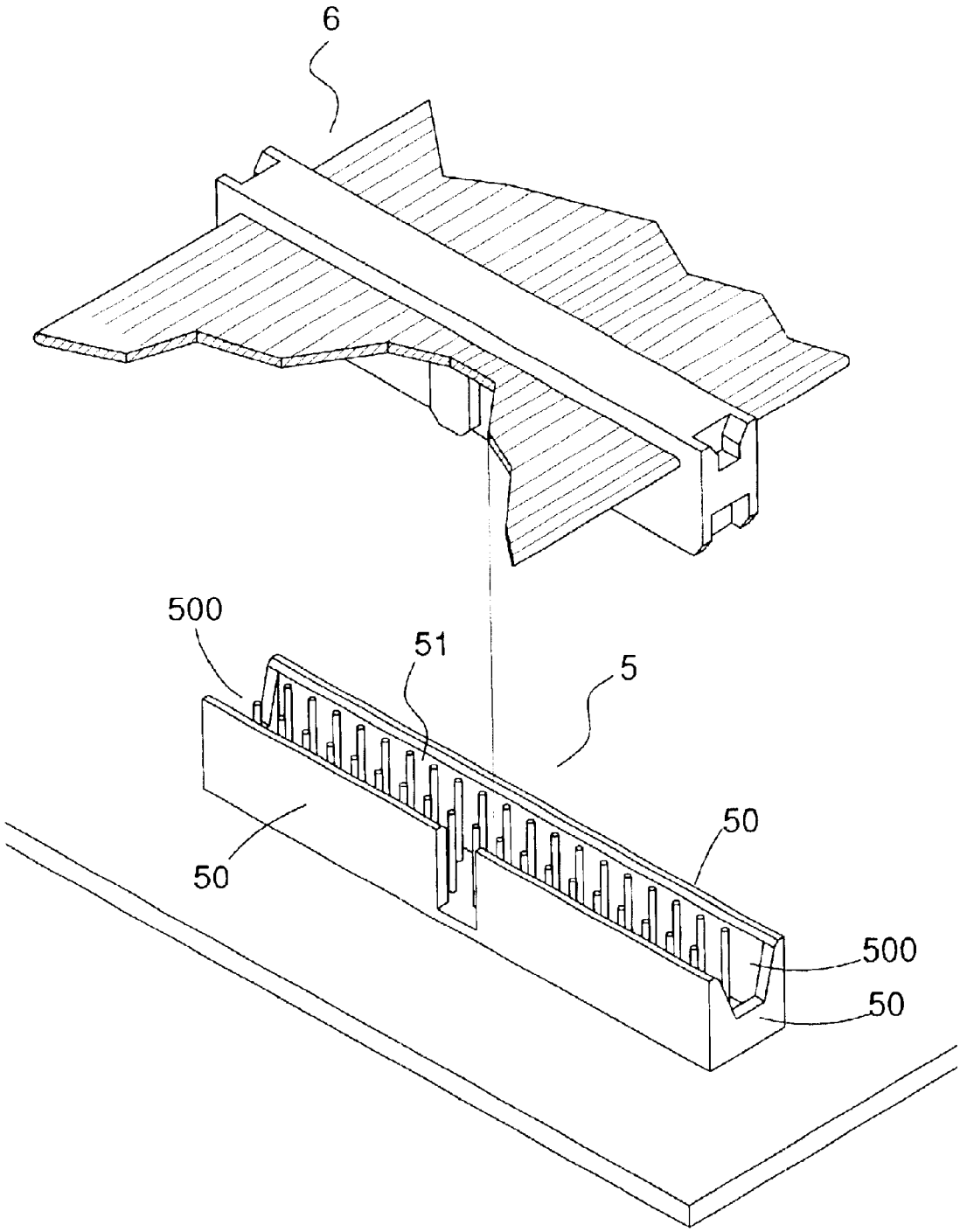
FIG. 4 (PRIOR ART)
FIG. 4 is a perspective view of a second conventional connector seat of a computer bus in accordance with the prior art.

Referring to FIGS. 1 and 2, each of the first side wall 20 and the third side wall 22 of the connector seat 2 is made flexible by existence of the openings 27, so that each of the first side wall 20 and the third side wall 22 of the connector seat 2 may be oscillated outward with a determined oscillation angle. Thus, when the user swings or oscillate the bus connector 1 so as to remove the bus connector 1 from the socket 24 of the connector seat 2, each of the first side wall 20 and the third side wall 22 of the connector seat 2 may be oscillated with the bus connector 1, so that each of the first side wall 20 and the third side wall 22 of the connector seat 2 will not be broken due to the stress or pressure produced when the user swings or oscillates the bus connector 1. In addition, each of the first side wall 20 and the third side wall 22 of the connector seat 2 is formed with an insertion recess 28 for snapping a side hook (not shown) of another bus connector (not shown), so that the connector seat 2 in accordance with the preferred embodiment of the present invention is also available for a bus connector having a side hook. Thus, the connector seat 2 in accordance with the preferred embodiment of the present invention is both available for a bus connector with a side hook and a bus connector 1 without a side hook. Further, the bus connector 1 is inserted into the socket 24 of the connector seat 2 in a close fit manner, so that the bus connector 4 cannot be detached from the socket 24 of the connector seat 2 easily.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A connector seat of a computer bus, having four side walls, wherein:

each of the four side walls has two adjacent side walls; and the connector seat is formed with at least two openings each located between one of the four side walls and each of its two adjacent side walls, so that the one side wall is capable of being oscillated outward;

each of the four side walls of the connector seat has a top having an inner side provided with a chamfered guide face which is extended through a whole length of the toy of each of the four side walls of the connector seat.

2. The connector seat of a computer bus in accordance with claim 1, wherein the connector seat has a first side wall, a second side wall located adjacent to the first side wall, a third side wall located opposite to the first side wall and located adjacent to the second side wall, and a fourth side wall located opposite to the second side wall and located adjacent to the first side wall and the third side wall, and the connector seat is formed with two openings each located between the first side wall and the second side wall and between the first side wall and the fourth side wall.

3. The connector seat of a computer bus in accordance with claim 1, wherein the connector seat has a first side wall, a second side wall located adjacent to the first side wall, a third side wall located opposite to the first side wall and located adjacent to the second side wall, and a fourth side wall located opposite to the second side wall and located adjacent to the first side wall and the third side wall, and the connector seat is formed with two openings each located between the third side wall and the second side wall and between the third side wall and the fourth side wall.

4. The connector seat of a computer bus in accordance with claim 1, wherein at least one of the four side walls of the connector seat is formed with an insertion recess extended to a bottom thereof.

5. The connector seat of a computer bus in accordance with claim 1, wherein one of the four side walls of the connector seat is formed with a positioning recess extended to a bottom thereof.

* * * * *